US005141142A

United States Patent [19]

Ramsey

[11] Patent Number: 5,141,142

[45] Date of Patent: Aug. 25, 1992

[54] METHOD AND APPARATUS FOR BURSTING PERFORATED WEB MATERIAL

[75] Inventor: James S. Ramsey, Shelton, Conn.

[73] Assignee: Pitney Bowes Inc., Stamford, Conn.

[21] Appl. No.: 680,605

[22] Filed: Apr. 1, 1991

Related U.S. Application Data

[63] Continuation of Ser. No. 399,124, Aug. 28, 1989, abandoned.

[51] Int. Cl.[5] ..... B65H 35/10

[52] U.S. Cl. ..... 225/4; 225/100

[58] Field of Search ..... 225/4, 100, 106

[56] References Cited

U.S. PATENT DOCUMENTS

| | | | |
|---|---|---|---|
| 4,284,221 | 8/1981 | Nagel et al. | 225/100 |
| 4,375,189 | 3/1983 | Berner et al. | 225/100 |
| 4,529,114 | 7/1985 | Casper et al. | 225/100 |

*Primary Examiner*—Hien H. Phan

*Attorney, Agent, or Firm*—Charles R. Malandra, Jr.; David E. Pitchenik; Melvin J. Scolnick

[57] ABSTRACT

A bursting apparatus and method for conveying a web of sheet material having successive transverse lines of weakening along a longitudinal path from an upstream position to a downstream position and for separating the web along a transverse line of weakening. The apparatus includes a longitudinally extending housing; a first pair of vertically spaced rollers rotatably mounted on the housing transverse to the path of web travel; a second pair of vertically spaced rollers rotatably mounted on the housing downstream of the first pair of rollers; a device for driving the downstream pair of rollers at a given speed; and a stepper motor for driving the upstream pair of rollers normally at the given speed and momentarily at a second speed, which is less than the given rate of speed, when the web of material is first gripped by the second pair of rollers, whereby severance of the web of material is promoted along the transverse line of weakening when the transverse line of weakening is disposed intermediate the first and second pairs of rollers.

5 Claims, 3 Drawing Sheets

METHOD AND APPARATUS FOR BURSTING PERFORATED WEB MATERIAL

This application is a continuation of application Ser. No. 399,124, filed Aug. 28, 1989, now abandoned.

BACKGROUND OF THE INVENTION

The instant invention relates to bursting apparatus and more particularly to the separation (tearing) of a continuous web of material along transverse lines of weakening.

Forms of stationery are often preprinted on a continuous web of perforated material. Such forms are conventionally used in billing and other typical business transactions. The continuous series of forms requires processing for end use such as mailing. This may require bursting or separating the forms, as well as the performance of the end functions of stacking, stamping, sealing, inserting, collating (for additional enclosures) and folding. The aforesaid end functions are all provided for with existing equipment in one continuous process.

It is known from U.S. Pat. No. 4,261,497, issued Apr. 14, 1981, and assigned to the assignee of the instant invention, to use two pairs of feed rollers perpendicular to the path of travel through which the web is fed for the purpose of bursting the web. A breaker roller is located in the path of travel between the two pairs of feed rollers for increasing tension along the line of web perforations and causing the webs to rupture along that line. A magnetic brake and a magnetic clutch are connected to opposite sides of the first feed roller. The clutch and brake work together to slow and halt the first (upstream) pair of feed rollers at predetermined times, as controlled by an electronic timing circuit. Since the second (downstream) pair of feed rollers is driven at a constant and continuous rate of speed, severance of the webs is promoted along the line of perforations as the downstream rollers pull the web against the restraining force of the upstream rollers.

In U.S. Pat. No. 4,284,221 issued Aug. 18, 1981, a method of bursting a web having transverse lines of weakening is disclosed in which the speed of the upstream pair of feed rollers is reduced below the speed of the downstream pair of feed rollers (and/or the speed of the downstream pair of feed rollers is increased above that of the upstream pair of feed rollers) when a weakened portion is located between the two pairs of feed rollers. An electromagnet is used to regulate the speed of the feed rollers.

In today's marketplace, it is desirable to be able to maximize the throughput of the web. In the '497 patent, throughput is not maximized because the upstream pair of feed rollers is brought to a stop. In the '221 patent, throughput is not maximized because as soon as a line of weakening is located between the two pairs of rollers the upstream pair is slowed. The slowing of the upstream pair of rollers is obviously effected prior to the optimum time of slowing in terms of maximizing throughput.

The instant invention overcomes the problems associated with the foregoing problems and provides a method and apparatus for bursting a web of sheet material having transverse lines of weakening while simultaneously maximizing the throughput of the bursting apparatus.

SUMMARY OF THE INVENTION

Accordingly, the instant invention provides a bursting apparatus and method for conveying a web of sheet material having successive transverse lines of weakening along a longitudinal path from an upstream position to a downstream position and for separating said web along a transverse line of weakening. The apparatus comprises: a longitudinally extending housing; a first pair of vertically spaced rollers rotatably mounted on said housing transverse to said path of web travel; a second pair of vertically spaced rollers rotatably mounted on said housing downstream of said first pair of rollers; means for driving said downstream pair of rollers at a given speed; and a stepper motor for driving said upstream pair of rollers normally at said given speed and momentarily at a second speed, which is less than said given rate of speed, when said web of material is first gripped by said second pair of rollers, whereby severance of said web of material is promoted along said transverse line of weakening when said transverse line of weakening is disposed intermediate said first and second pairs of rollers.

DESCRIPTION OF THE PREFERRED EMBODIMENT

Figure 1:
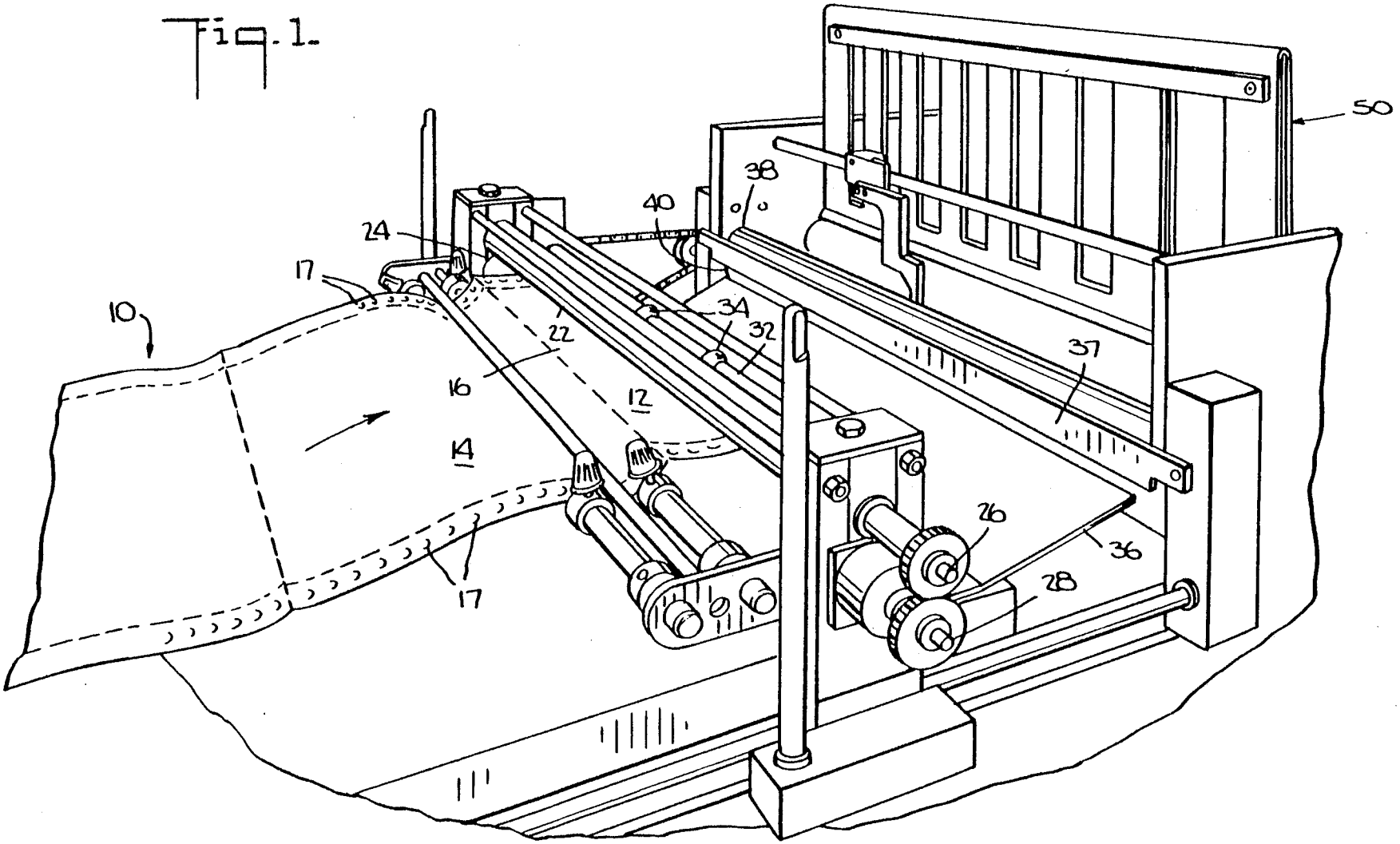
FIG. 1 is a perspective front view of bursting apparatus in accordance with the instant invention operating on a continuous web of forms.

In describing the preferred embodiment of the instant invention, reference is made to the drawings, wherein there is seen in FIG. 1 a continuous web of forms 10 of a type which are to be processed for ultimate use, such as folding, inserting into envelopes, and mailing. The forms 10 are continuous with the first form in the series, illustrated as form 12, succeeded by the next form 14, which forms are delineated by a perforated line 16 therebetween. The embodiment of the web of forms 10 shown in FIG. 1 shows a plurality of sprocket holes 17 along each side edge of the web. Alternatively no sprocket holes 17 need be present for proper operation of the present invention.

Alternatively, two continuous series of forms 10 can be processed with so-called "two-up" technique by which a first series of forms 10 overlays another series of forms 10. The forms 12 of one series are staggered with respect to the forms 12 of the other series by the distance of one half the length of an individual form 12. The perforation lines 16 of one series of forms 10 are superimposed intermediate the perforation lines 16 of the overlayed series of forms 10. For purposes of the description hereinafter presented, the series of forms 10 is referred to as a single web of material; but it is to be understood that the present invention is also intended to process and separate individual forms from two distinct webs fed in staggered relationship with each other by an upper infeed roller 22 and a lower infeed roller 24. The infeed (feed) rollers 22 and 24 are axially mounted on a upper infeed roller shaft 26 and a lower infeed roller shaft 28 respectively. The emergent forms 10 are then fed under a breaker roller 32 having two spheres 34 axially mounted thereon. Alternatively three or more spheres 34 may be used and can be movable to intermediate positions along the breaker roller 32.

A guide plate 36 is bent upwardly away from the infeed rollers 22 and 24 to direct the emergent forms 10. A retaining bar 37 is suitably mounted by conventional means above the guide plate 36 and extends perpendicular to the path of form travel. A pair of outfeed (burst) rollers consisting of an upper outfeed roller 38 and a lower outfeed roller 40, axially mounted respectively on an upper outfeed roller shaft and a lower outfeed roller shaft (not shown), then grip the emergent forms 10. A pair of paper sensors 46 and 48 are suitably mounted by conventional means upstream and downstream of the pair of outfeed rollers 38 and 40. (See FIG. 2)

Figure 2:
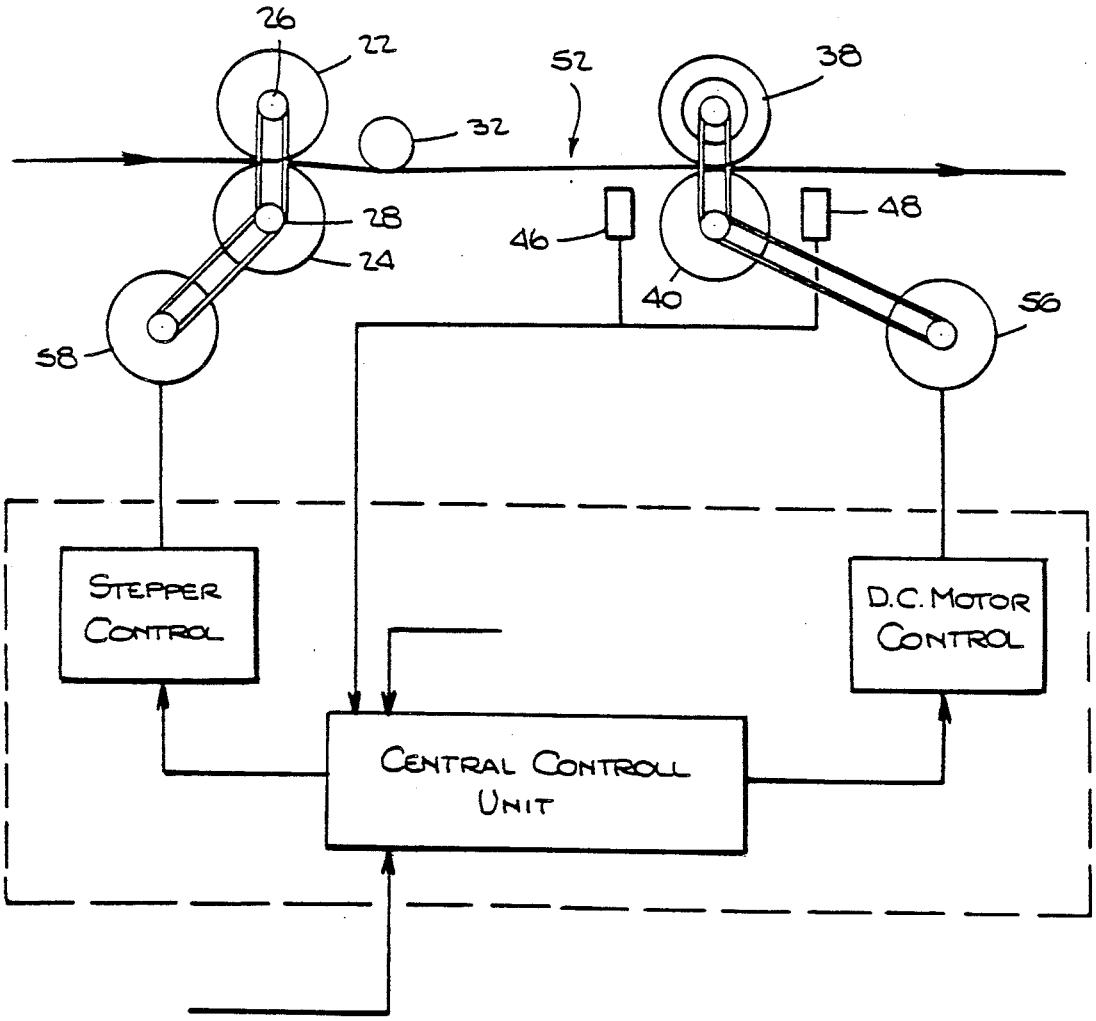
FIG. 2 is a schematic, side elevational view of the bursting apparatus seen in FIG. 1.

Referring now to FIG. 2, it can be seen that the breaker roller 32 is mounted in the bursting apparatus so that the lower surface of the spheres 34 extends below the normal path of form travel. The rollers 22, 24, 38 and 40 are the essential elements of the bursting apparatus seen in FIG. 2 and generally designated 52.

The drive means for the rollers 22, 24, 38 and 40 is conventional, consisting of sprocket pulleys and chain belts, and for a further explanation, reference may be made to U.S. Pat. No. 4,261,497, issued Apr. 14, 1981.

As seen in FIG. 1, the bursting apparatus 52 shown in FIG. 2 is a component of a larger system which may include a buckle chute folder 50 shown downstream of the outfeed rollers 38 and 40. The folder 50 may be employed to impart a fold to each of the emergent forms 10 prior to their likely insertion into an envelope at an inserting station (not shown) which would be situated downstream of the buckle chute folder 50. In a typical operation, a continuous web of forms 10 (e.g. computer paper) is fed into the infeed rollers 22 and 24. The length of the individual forms is known once the paper arrives at the bursting apparatus 52. The length is utilized to set up certain mechanics and to preset electronic page length measuring circuits, all of which is well known in the art.

As disclosed in the aforementioned U.S. Pat. No. 4,261,497, issued Apr. 14, 1981, it is well known to adjust by conventional means the position of the infeed rollers 22 and 24 and outfeed rollers 38 and 40 relative to the length of form 12.

Figure 3:
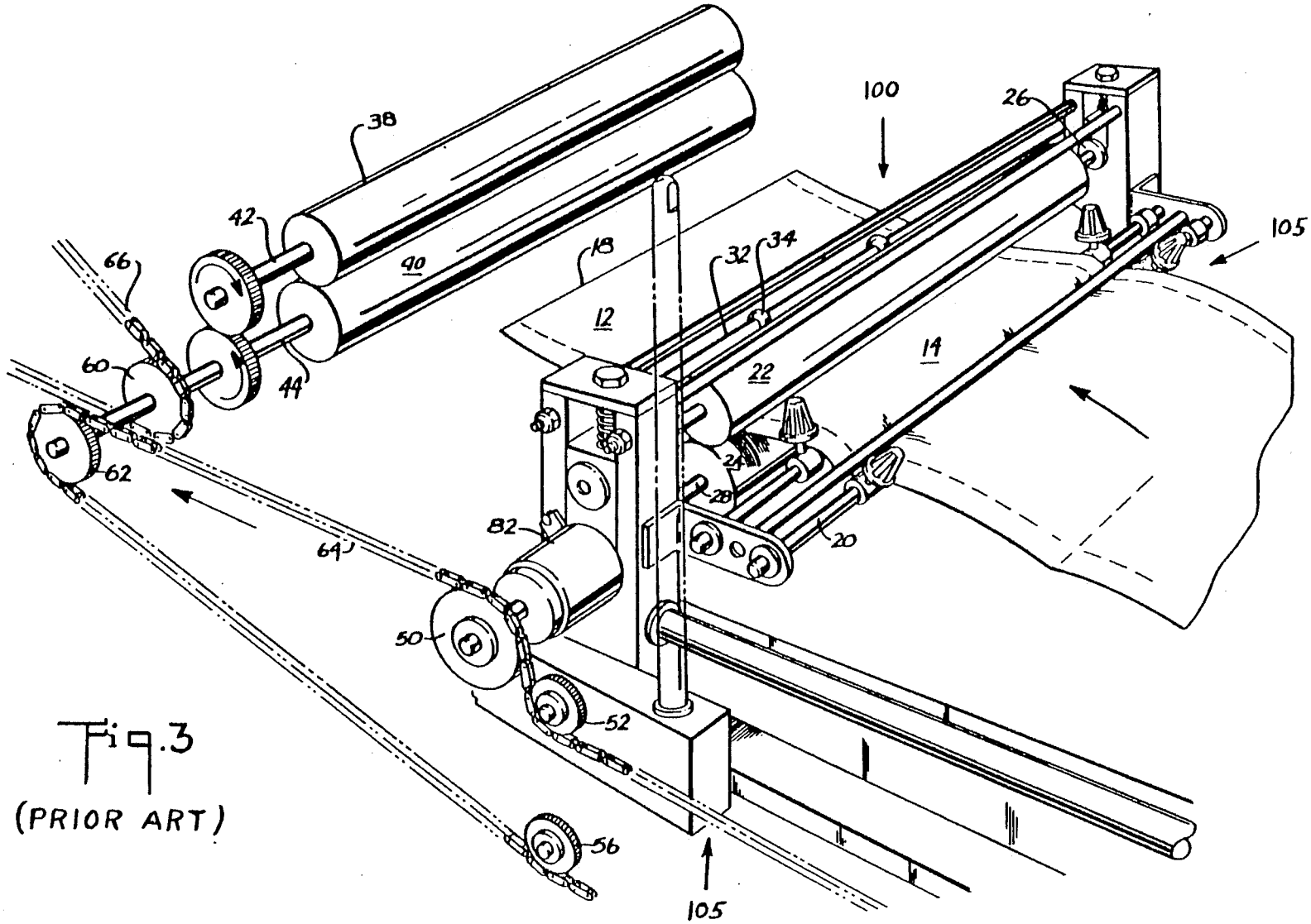
Fig. 3 (PRIOR ART)
FIG. 3 is a perspective rear view of the drive means of a prior art bursting apparatus.

As shown in FIG. 3, for example, the infeed roller assembly 100 is mounted on each side to a bracket and rail assembly 105 whereby infeed roller assembly 100 can be adjustably positioned from the outfeed rollers 38 and 40.

The burster 52 begins to feed the web 10 when a feed demand signal is received from the host system of which the burster 52 is a component. The paper web is fed until such time as it is signalled to stop. The stop signal is generally a preset number of papers or the recognition of a specific optical mark on the web, all of which is well known in the art.

As is known in classical bursting techniques, the burst rollers (outfeed rollers 38 and 40) run at constant velocity "x". The feed rollers (infeed rollers 22 and 24) run at 178 "x". When the web paper enters the nip of the burst rollers, the speed differential creates tension on the web. At this moment, the perforation line (16) is tangent to the breaker roller 32 (burst cone) which applies a normal force to the perforation line 16 which in turn creates a perforation separation. Now the individual form is separated from the web and moves at "x" velocity downstream.

Referring now to FIG. 2, there is a D.C. motor 56 for the outfeed rollers 38 and 40 and a stepper motor 58 for the infeed rollers 22 and 24. As indicated in FIG. 2, there is a D.C. motor control for the D.C. motor 56 and a stepper control for the stepper motor 58. The stepper motor and control therefor allow for matching the speed of the infeed rollers 22 and 24 to the speed of the outfeed rollers 38 and 40 and to vary the speed of the infeed rollers 22 and 24 dynamically.

In operation, the infeed rollers 22 and 24 run at the same speed as the outfeed rollers 38 and 40 until just before the next burst is required, at which time the infeed rollers 22 and 24 slow down ( owing to the stepper motor 58 and the stepper control) so that a speed differential is effected between the infeed rollers 22 and 24 and the outfeed rollers 38 and 40 which is appropriate for bursting. Once the web 10 is bursted, the infeed rollers 22 and 24 increase and resume their speed until just prior to the next burst time. This action is effected by the stepper control and stepper motor 58 repeatedly, thus assuring the bursting of each of the forms from the web 10 in a method which allows for the maximum throughput of separated forms.

It should be understood by those skilled in the art that various modifications may be made in the present invention without departing from the spirit and scope thereof, as described in the specification and defined in the appended claims.

What is claimed is:

1. A method of conveying a web of sheet material having successive transverse lines of weakening along a longitudinal path from an upstream position to a downstream position and for separating said web along a transverse line of weakening comprising:

driving a downstream pair of feed rollers transverse to said longitudinal path by a D.C. motor at a given speed;

driving an upstream pair of feed rollers transverse to said longitudinal path by a stepper motor at said given speed;

feeding said web to said upstream pair of feed rollers at said given rate of speed;

driving said upstream pair of feed rollers momentarily at a second speed, which is less than said given speed, when a leading edge of said web of material is first gripped by said second pair of feed rollers, whereby severance of said web of material is promoted along said transverse line of weakening when said transverse line of weakening is disposed intermediate said downstream and upstream pairs of feed rollers.

2. The method of claim 1, comprising the further step of resuming said given speed following the severance of said web.

3. A bursting apparatus for conveying a web of sheet material having successive transverse lines of weakening along a longitudinal path from an upstream position to a downstream position and for separating said web along a transverse line of weakening, comprising:

a longitudinally extending housing;

a first pair of vertically spaced rollers rotatably mounted on said housing transverse to said longitudinal path;

a second pair of vertically spaced rollers rotatably mounted on said housing transverse to said longitudinal path and downstream of said first pair of rollers, and first pair of rollers being movable relative to said second pair of rollers salon said longitudinal path for accommodating different lengths of said web of material between said successive transverse lines of weakening;

a D.C. motor for driving said second pair of rollers at a given speed;

a stepper motor for driving said first pair of rollers normally at said given speed and momentarily at a second speed when a leading edge of said web of material is first gripped by said second pair of rollers, said second speed being less than said given speed, whereby severance of said web of material is promoted along said transverse line of weakening when said transverse line of weakening is disposed intermediate said first and second pairs of rollers; and a breaker roller mounted on said housing transverse to said longitudinal path intermediate said first and second paris of rollers for causing longitudinal tension along said web of material thereby creating a tendency of rupture along said transverse line of weakening.

4. The apparatus of claim 3, wherein the lower surface of said breaker roller extends below said longitudinal web path, whereby said longitudinal tension is created along said web of material.

5. The apparatus of claim 3, wherein said second speed is one half said given speed.

* * * * *